United States Patent [19]

Mori et al.

[11] Patent Number: 4,493,071

[45] Date of Patent: Jan. 8, 1985

[54] PICKUP CARTRIDGE

[75] Inventors: Yoshihisa Mori, Tokyo; Hachisiro Kobayashi, Machida; Mitsuru Takashima, Tokyo, all of Japan

[73] Assignee: Sony Corporation, Tokyo, Japan

[21] Appl. No.: 351,427

[22] Filed: Feb. 23, 1982

[30] Foreign Application Priority Data

Mar. 18, 1981 [JP] Japan ..... 56-37744[U]

[51] Int. Cl.[3] ..... H04R 11/12

[52] U.S. Cl. ..... 369/146

[58] Field of Search ..... 369/146, 149, 148, 147; 360/123

[56] References Cited

U.S. PATENT DOCUMENTS

| | | | |
|---|---|---|---|
| 3,146,319 | 8/1964 | Stanton | 369/146 |
| 3,646,279 | 2/1972 | Stanton | 369/149 |
| 4,103,116 | 7/1978 | Mishima | 369/146 |

*Primary Examiner*—Alan Faber

*Attorney, Agent, or Firm*—Lewis H. Eslinger; Alvin Sinderbrand

[57] ABSTRACT

The present invention is directed to a pickup cartridge used for reproducing an information recorded on a record disc, the pickup cartridge having a magnet, a stylus which engages a spiral groove on the record disc, a pole piece for forming a path for a magnetic flux generated by the magnet and varied in response to the movement of the stylus and a wire coil wound on the pole piece for producing a signal voltage. The pole piece is made of magnetic material with electrical conductivity, such as permalloy, and is provided with an output electrode portion at one end. One end of the coil wire is connected electrically to the pole piece. The signal voltage is induced in the coil in response to variations in the magnetic flux passing through the pole piece and is fed to the output electrode portion at the end of the pole piece.

7 Claims, 4 Drawing Figures

PICKUP CARTRIDGE

BACKGROUND OF THE INVENTION

The present invention relates generally to pickup cartridges for converting an information recorded on a record medium with a groove formed on the surface thereof to an electrical signal, and more particularly to a pickup cartridge of the moving magnet type or the induced magnet type whose signal feeding portion, from which a signal voltage induced in a coil provided therein is derived, is so improved in its structure that high productivity is obtained and production of the cartridge can be automated.

Although various pickup cartridges for converting an audio information recorded with a spiral sound groove formed on the surface of a record disc to an electrical audio signal have been proposed, electromagnetic pickup cartridges, as one of the various types of pickup cartridges, have been generally used recently.

Two of the various types of electromagnetic pickup cartridges are a moving magnet pickup cartridge (hereinafter referred to as M M pickup cartridge) and an induced magnet pickup cartridge (hereinafter referred to as I M pickup cartridge). The M M pickup cartridge is advantageous in that a relatively large signal voltage can be obtained as an output and it is easy to use in comparison with other types of electromagnetic pickup cartridges such as the I M pickup cartridge, and therefore a record player which employs the M M pickup cartridge is widely utilized.

However, in manufacturing the previously proposed M M pickup cartridge, very delicate and complicated work is required for assembling a signal feeding portion of the pickup cartridge for feeding a reproduced signal voltage out of the cartridges. This troublesome work in the production process decreases the productivity of the previously proposed M M pickup cartridge and further hinders the automation of the production process.

Manufacture of the previously proposed I M pickup cartridge is similarly affected.

OBJECTS AND SUMMARY OF THE INVENTION

It is an object of the present invention to provide a pickup cartridge of the moving magnet type or the induced magnet type which has a signal feeding portion improved in its structure.

Another object of the present invention is to provide a pickup cartridge of the moving magnet type or the induced magnetic type having an improved signal feeding portion which can be assembled easily.

A further object of the present invention is to provide an improved M M or I M pickup cartridge having high productivity and being suitable for automating the production process thereof.

According to one aspect of the present invention, in an M M pickup cartridge or an I M pickup cartridge having a stylus, a coil in which a signal voltage is induced in response to the movement of the stylus, a pole piece to which the coil is attached and a signal feeding portion for feeding the signal voltage to the outside, the coil is attached to the pole piece in an improved manner and the structure of the signal feeding portion is improved.

Other objects, advantages and features of the present invention will become apparent from the following description taken in conjunction with the accompanying drawings.

DESCRIPTION OF THE PREFERRED EMBODIMENTS

Figure 1:
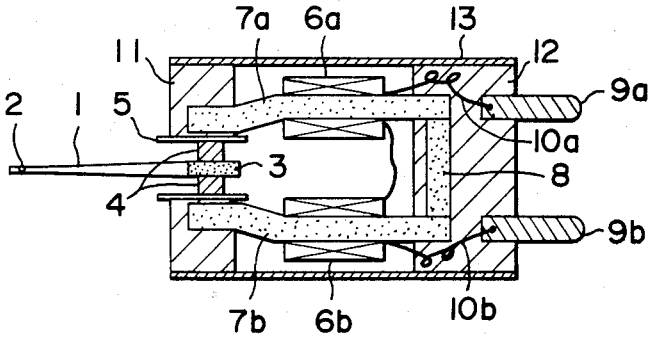
FIG. 1 PRIOR ART
FIG. 1 is a sectional view showing a previously proposed M M pickup cartridge.

In order to understand the description of the preferred embodiments of the invention, the previously proposed M M pickup cartridge will be explained with reference to FIG. 1. In FIG. 1, a cantilever 1 has a stylus 2 which engages with, for example, a spiral sound groove on a record disc, at one end portion of the cantilever. A magnet 3 for generating a magnetic flux is connected to the other end portion of the cantilever 1. The magnet 3 is held by a damper 4 made of rubber or the like so as to form a vibrator which vibrates in response to the movement of the stylus 2. The damper 4 is attached to a sleeve 5 made of brass or the like. In relation to the magnet 3 forming the vibrator, a pair of pole pieces 7*a* and 7*b*, to which a pair of coils 6*a* and 6*b* is attached, respectively, is provided for forming a path for the magnetic flux which is generated by the magnet 3 and which varies in response to the vibration thereof. The pole pieces 7*a* and 7*b* are made of magnetic material. One end of each pole piece is positioned adjacent to a side of the magnet 3 and the other ends of the pole pieces are magnetically coupled together through a magnetic yoke 8. 9*a* and 9*b* represent a couple of output electrodes made of conductive material. End portions 10*a* and 10*b* of the coils 6*a* and 6*b* are soldered to the electrodes 9*a* and 9*b*, respectively, and the electrodes 9*a* and 9*b* feed a signal voltage, which is induced in each of the coils 6*a* and 6*b* in response to variations in the magnetic flux passing through the pole pieces 7*a* and 7*b*, out of the cartridge. The sleeve 5 made of brass or the like, the pole pieces 7*a* and 7*b*, the magnetic yoke 8, the electrodes 9*a* and 9*b* and so on as mentioned above are held by holders 11 and 12 of plastic formation and contained in a shield case 13.

One of the steps in manufacturing the previously proposed M M pickup cartridge is to connect electrically the coils 6*a* and 6*b*, each of which is formed by winding a fine wire, on one of the pole pieces 7*a* and 7*b*, to the electrodes 9*a* and 9*b*, respectively, by soldering the end portions 10*a* and 10*b* of the coils 6*a* and 6*b* to the electrodes 9*a* and 9*b*, respectively. It is very difficult to handle the end portions 10*a* and 10*b* of the coils 6*a* and 6*b*. Accordingly, the productivity of the previously proposed M M pickup cartridge decreases. Electrically connecting the coil end portions 10*a* and 10*b* to the electrode 9*a* and 9*b*, respectively, is even more difficult if the electrodes 9*a* and 9*b* are to be positioned in a predetermined manner. This hinders the automation of the production process.

A similar situation exists for the previously proposed I M pickup cartridge which has a lightweight pipe or tube (μ pipe) which acts as a vibrator and is made of magnetic material having high permeability, the lightweight pipe being connected to a cantilever and a fixed magnet placed at the position adjacent to the lightweight pipe.

Figure 2:
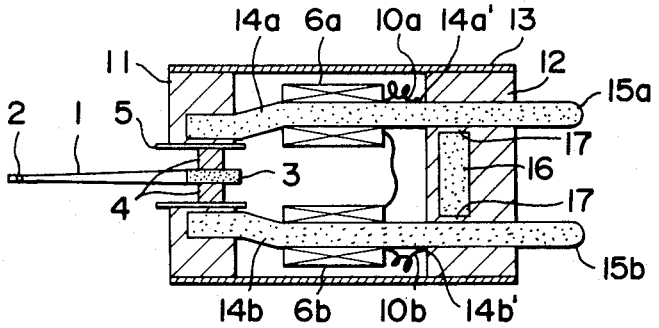
FIG. 2 is a sectional view showing one embodiment of a pickup cartridge according to the present invention.
Figure 4:
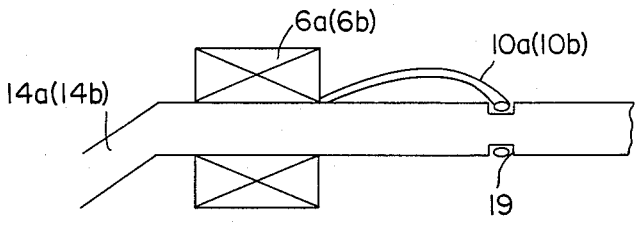
FIG. 4 is a fragmentary sectional view showing still another embodiment of the invention.

FIG. 2 shows an example of an M M pickup cartridge according to the present invention. In the example shown in FIG. 2, the cantilever 1, stylus 2, magnet 3, damper 4 and sleeve 5 are also provided in the same manner as the M M pickup cartridge shown in FIG. 1. However, in this embodiment, pole pieces 14*a* and 14*b*, to which the coil 6*a* and 6*b* are attached, respectively, are made in the form of a couple of bars of magnetic material having electrical conductivity, namely, conductive magnetic material such as permalloy. The coils 6*a* and 6*b* are wound on the pole pieces 14*a* and 14*b*, respectively. First end portions of the coils are connected together and second end portions 10*a* and 10*b* are connected electrically to the pole pieces 14*a* and 14*b*, respectively. In order to make this electrical connection, the second end portions 10*a* and 10*b* of the coils 6*a* and 6are soldered respectively to the pole pieces 14*a* and 14*b* at positions 14*a*' and 14*b*' thereon, as shown in FIG. 2, or alternatively the end portions 10*a* and 10*b* of the coils 6*a* and 6*b* are stuffed into fine grooves 19 provided on the surfaces of the pole pieces 14*a* and 14*b*, respectively as shown in FIG. 4. First end portions of the pole pieces 14*a* and 14*b*, on which the coils 6*a* and 6*b* are wound and to which end portions 10*a* and 10*b* of the coils are electrically connected are held in place by a holder 11 of plastic formation so as to be positioned adjacent opposite sides of the magnet 3. Thus, if the sleeve 5 is made from a conductive material such as brass, the pole pieces 14*a* and 14*b* are insulated from the sleeve 5. Second end portions of the pole pieces 14*a* and 14*b* are elongated and extend through a holder 12 of plastic formation and project externally from the pickup cartridge so as to form output electrodes 15*a* and 15*b*, respectively. Thus, a signal voltage which is induced in each of the coils 6*a* and 6*b* in response to variations in the magnetic flux passing through the pole pieces 14*a* and 14*b* is fed to each of the output electrodes 15*a* and 15*b* which are formed by end portions of the conductive pole pieces 14*a* and 14*b*.

A magnetic yoke 16 is provided which, together with the pole pieces 14*a* and 14*b*, form a path for the magnetic flux. In this path for the magnetic flux, a couple of narrow gaps are formed between the magnetic yoke 16 and the pole piece 14*a* and between the magnetic yoke 16 and the pole piece 14*b*, to make electrically insulating spaces thereat so that the pole pieces 14*a* and 14*b* are prevented from being connected electrically to each other through the magnetic yoke 16. A shield case 13 housing all of the internal portions and parts of the pickup cartridge mentioned above is also provided in the same manner as the M M pickup cartridge shown in FIG. 1.

In accordance with the above mentioned structure, because the electrodes 15*a* and 15*b* are integral portions of the pole pieces 14*a* and 14*b*, it is not required to provide any other electrodes made of conductive material. Further, because the signal feeding portion is formed merely by connecting electrically the end portions 10*a* and 10*b* of the coils 6*a* and 6*b* to the pole pieces 14*a* and 14*b*, respectively, assembly of the pickup cartridge is simplified.

Figure 3:
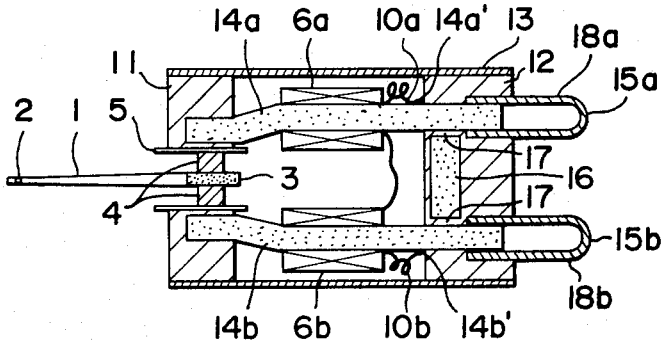
FIG. 3 is a sectional view showing another embodiment of a pickup cartridge according to the present invention.

FIG. 3 shows another embodiment of the M M pickup cartridge according to the present invention. In FIG. 3, the references common to FIG. 2 are used to indicate the corresponding portions and the explanation of these portions will be abridged. In this embodiment, the second end portions of the pole pieces 14*a* and 14*b* do not extend entirely through the holder 12 nor project externally from the cartridge but rather terminate in the holder 12. A couple of conductive caps 18*a* and 18*b* are rigidly and electrically connected to the end portions of the pole pieces 14*a* and 14*b*, respectively, and the end portions of the conductive caps 18*a* and 18*b* project externally from the cartridge so as to form output electrodes 15*a* and 15*b*. Also in this embodiment, the coils 6*a* and 6*b* are wound on the pole pieces 14*a* and 14*b*, respectively, and the end portions 10*a* and 10*b* of the coils 6*a* and 6*b* are connected electrically to the pole pieces 14*a* and 14*b*. The signal voltage induced in each of the coils 6*a* and 6*b* is fed to the electrodes 15*a* and 15*b*, which are formed by the conductive caps 18*a* and 18*b*, through the pole pieces 14*a* and 14*b*. With the embodiment shown in FIG. 3, assembly of the pickup cartridge is greatly simplified. Furthermore, because the pole pieces 14*a* and 14*b* are completely contained in the shield case 13, noise external to the cartridge is prevented by the shield case 13 from entering the cartridge and mixing with the signal voltage.

Although a single pair of pole pieces and a single pair of coils wound on the pole pieces are provided in the embodiments of FIG. 2 and FIG. 3, in the case of an M M pickup cartridge for reproducing a stereophonic sound signal, two pairs of pole pieces are provided, each pole piece having a wire coil wound thereon with one end portion of the coil wire connected electrically thereto and an electrode formed at an end portion thereof to feed a signal voltage induced in each of th coils out of the cartridge.

Further, the structure of an I M pickup cartridge can be also modified in a manner similar to that for the M M pickup cartridges mentioned above, as a further embodiment of the present invention. In the case of the I M pickup cartridge, the pole pieces, each of which has one end portion positioned adjacent to the lightweight pipe (μ pipe), are made of conductive magnetic material and have output electrodes formed at their end portions.

Shapes and arrangements of each portions of the M M or I M pickup cartridge according to the present invention should not be limited to the examples shown in FIG. 2 and FIG. 3, and variations and modifications may be effected without departing from the scope of the novel concept of the invention.

As apparent from the above explanation, the manufacture of a pickup cartridge such as that shown in FIG. 1 can be greatly simplified. No longer is it necessary to draw out the end portion of the coil wire, solder it to an electrode which is separate from the pole piece and carefully position the electrode in the cartridge. Rather, the present invention merely requires winding the coil on the pole piece and connecting an end of the coil wire electrically to the pole piece. As a result productivity of the pickup cartridge according to the present invention is advanced and production of the cartridge can be automated.

What we claim is:

1. A pickup cartridge comprising:

pole pieces formed of magnetically and electrically conductive material;

a magnetic yoke cooperating with said pole pieces to form a magnetic flux path therewith and being electrically isolated from said pole pieces;

coils on said pole pieces, respectively, for producing an electrical signal in response to a varying magnetic flux in said pole pieces, said coils being electrically connected with said pole pieces, respectively;

means extending adjacent portions of said pole pieces for varying a magnetic flux in said pole pieces in accordance with information recorded on a record medium; and output means extending from and electrically connected with other portions of said pole pieces for feeding said electrical signal from the cartridge through an electrical circuit which includes said pole pieces.

2. A pickup cartridge according to claim 1; in which said output means consists of integral end portions of said pole pieces.

3. A pickup cartridge according to claim 1; in which said pole pieces are elongated and, at one end portions, are adjacent said means for varying a magnetic flux in said pole pieces, said output means consists of the other end portions of said elongated pole pieces, and said coils are disposed on said pole pieces between said end portions of the latter.

4. A pickup cartridge according to claim 1; in which said output means include electrode elements connected rigidly and electrically to end portions of said pole pieces.

5. A pickup cartridge according to claim 1; wherein said means for varying a magnetic flux in said pole pieces includes a cantilever having a stylus at one end and a magnet mounted on another end, said cantilever being movably mounted in relation to end portions of said pole pieces.

6. A pickup cartridge according to claim 1; wherein each said coil is soldered to said respective pole piece.

7. A pickup cartridge according to claim 1; wherein each said pole piece has a groove formed therein and an end of each said coil is engaged in said groove of the respective pole piece for effecting the electrical connection therewith.

* * * * *